US011135605B2

(12) United States Patent
Iwase et al.

(10) Patent No.: US 11,135,605 B2
(45) **Date of Patent: *Oct. 5, 2021**

(54) ELECTROSTATIC COATER AND ELECTROSTATIC COATING METHOD

(71) Applicant: Ransburg Industrial Finishing K.K., Kanagawa (JP)

(72) Inventors: Masatoshi Iwase, Yokohama (JP); Naoki Ota, Yokohama (JP); Kenji Okamoto, Yokohama (JP)

(73) Assignee: Ransburg Industrial Finishing K.K., Kanagawa (JP)

( * ) Notice: Subject to any disclaimer, the term of this patent is extended or adjusted under 35 U.S.C. 154(b) by 113 days.

This patent is subject to a terminal disclaimer.

(21) Appl. No.: 16/426,995

(22) Filed: May 30, 2019

(65) Prior Publication Data

US 2019/0275537 A1 Sep. 12, 2019

Related U.S. Application Data

(63) Continuation of application No. 14/764,560, filed as application No. PCT/JP2014/051197 on Jan. 22, 2014, now Pat. No. 10,315,205.

(30) Foreign Application Priority Data

Jan. 30, 2013 (JP) ..... 2013-015892

(51) Int. Cl.
*B05B 14/42* (2018.01)
*B05B 5/025* (2006.01)
(Continued)

(52) U.S. Cl.
CPC ..... *B05B 5/053* (2013.01); *B05B 5/025* (2013.01); *B05B 5/0255* (2013.01); *B05B 5/04* (2013.01); *B05B 13/0431* (2013.01); *B05B 14/42* (2018.02)

(58) Field of Classification Search
CPC ..... B05B 12/08; B05B 5/04; B05B 5/0407; B05B 5/043; B05B 5/053; B05B 5/0255;
(Continued)

(56) References Cited

U.S. PATENT DOCUMENTS 3,863,180 A 1/1975 Parson
4,187,527 A 2/1980 Bentley
(Continued)

FOREIGN PATENT DOCUMENTS

JP 06-99109 4/1994
JP 08-108110 4/1996
(Continued)

OTHER PUBLICATIONS

PCT International Search Report; Application No. PCT/JP2014/051197; dated Apr. 15, 2014; 2 pages.
(Continued)

*Primary Examiner* — Alexander M Weddle
(74) *Attorney, Agent, or Firm* — Fletcher Yoder, P.C.

(57) ABSTRACT

A charge remaining in an electrostatic coater when power supply to the electrostatic coater is stopped is neutralized at an early stage.

A rotary atomizing head 102 receives a high voltage of negative polarity from a cascade 104. An electrostatic coater 100 further includes a second high-voltage generator 110 that generates a high voltage of positive polarity. The second high-voltage generator 110 is composed of a Cockcroft-Walton circuit. The Cockcroft-Walton circuit is composed of diodes and capacitors. A high voltage of the electrostatic coater 100 is controlled by a controller 10. Immediately after running of the electrostatic coater 100 is stopped by stopping power supply to the cascade 104, power is supplied to the second high-voltage generator 110. The high voltage of
(Continued)

positive polarity generated by the second high-voltage generator 110 is supplied to the rotary atomizing head 102 for a predetermined time period.

20 Claims, 6 Drawing Sheets

(51) Int. Cl.

| | |
|---|---|
| ***B05B 5/053*** | (2006.01) |
| ***B05D 1/04*** | (2006.01) |
| ***B05B 5/04*** | (2006.01) |
| ***B05B 13/04*** | (2006.01) |

(58) Field of Classification Search
CPC ..... B05B 5/025; B05B 14/42; B05B 13/0431; B05B 13/0452; B05D 1/04
See application file for complete search history.

(56) References Cited

U.S. PATENT DOCUMENTS

| | | | |
|---|---|---|---|
| 5,103,763 | A | 4/1992 | Goldowsky et al. |
| 5,222,663 | A | 6/1993 | Noakes et al. |
| 5,684,666 | A | 11/1997 | Noakes et al. |
| 10,315,205 | B2 * | 6/2019 | Iwase ..... B05B 5/0255 |
| 2004/0255865 | A1 | 12/2004 | Morita et al. |
| 2007/0039546 | A1 | 2/2007 | Amari et al. |
| 2007/0227445 | A1 | 10/2007 | Yamada |
| 2009/0134249 | A1 | 5/2009 | Uratani et al. |
| 2012/0240851 | A1 | 9/2012 | Murata et al. |

FOREIGN PATENT DOCUMENTS

| | | | |
|---|---|---|---|
| JP | 3042773 | | 10/1997 |
| JP | 2003164777 | A * | 6/2003 |
| JP | 2003-164777 | | 10/2003 |
| JP | 2009-193793 | A | 8/2009 |
| JP | 2012-050949 | | 3/2012 |
| WO | 2012/028942 | A2 | 3/2012 |

OTHER PUBLICATIONS

EP Extended Search Report; Application No. EP 14746861.5; dated Aug. 4, 2016; 6 pages.
European Office Action for EP Application No. 14746861.5 dated Jul. 10, 2017, 4 pgs.
European Examination Report for EP Application No. 14746861.5 dated Feb. 7, 2018, 3 pgs.
Chinese Office Action for CN Application No. 201480005330.8 dated Feb. 24, 2017, 6 pgs.

* cited by examiner

ELECTROSTATIC COATER AND ELECTROSTATIC COATING METHOD

CROSS-REFERENCE TO RELATED APPLICATIONS

This application is a continuation of National Stage application Ser. No. 14/764,560, entitled "ELECTROSTATIC COATER AND ELECTROSTATIC COATING METHOD", filed Jul. 29, 2015, which is herein incorporated by reference in its entirety, which claims priority and benefit of PCT Patent Application No. PCT/JP2014/051197, entitled "ELECTROSTATIC COATER AND ELECTROSTATIC COATING METHOD", filed Jan. 22, 2014, which is herein incorporated by reference in its entirety, and which claims priority to and benefit of Japanese Patent Application No. JP2013-015892, entitled "ELECTROSTATIC COATER AND ELECTROSTATIC COATING METHOD", filed Jan. 30, 2013, which is herein incorporated by reference in its entirety.

BACKGROUND OF THE INVENTION

The present invention relates to an electrostatic coater, and typically relates to safety measures when a coater abnormally approaches a workpiece (an object to be coated).

For example, electrostatic coaters are generally used for coating of automobiles. The coating of automobiles has been robotized. A coating robot is installed in a coating booth. The coating booth is an explosion-proof space. The coating robot is connected to a controller installed outside the coating booth via a cable. An electrostatic coater of the coating robot is controlled based on an instruction from the controller.

Patent Literature 1 (Japanese Patent Laid-Open No. 2012-50949) discloses an electrostatic coater in which a high-voltage generator is incorporated. This type of electrostatic coater includes a bleeder resistance for safety measures in addition to the incorporated high-voltage generator, and the electrostatic coater is grounded via the bleeder resistance at all times. When power supply to the electrostatic coater is stopped, a charge accumulated in the electrostatic coater is discharged outside through the bleeder resistance. Accordingly, an accident due to the charge retained in the electrostatic coater immediately after the power supply is stopped would be prevented from occurring. For example, a spark discharge when the electrostatic coater abnormally approaches a workpiece can be prevented from occurring.

Patent Literature 1: Japanese Patent Laid-Open No. 2012-50949

Coating efficiency of electrostatic coating is defined as follows. The coating efficiency means a ratio of an amount of paint attached to the workpiece to an amount of paint discharged toward the workpiece from the electrostatic coater. When the coating efficiency is improved, an amount of paint usage can be reduced so that various means for improving the coating efficiency have been taken. An example of the means is given in which a voltage applied to the electrostatic coater is increased to a higher voltage. Another example is given in which a distance between the electrostatic coater and the workpiece is decreased.

However, the means for improving the coating efficiency as described above bring a tendency to increase a risk of the occurrence of the spark discharge between the electrostatic coater and the workpiece. Accordingly, a method has been considered as safety measures thereof in which a resistance value of the bleeder resistance is lowered.

The bleeder resistance is incorporated in the electrostatic coater in order to partially discharge power supplied to the electrostatic coater at all times for safety measures. When the resistance value of the bleeder resistance is lowered, an amount of discharged power is increased. That is, lowering the value of the bleeder resistance causes an increase in power amount wastefully discharged outside from the power supplied to the electrostatic coater. This means that an absolute value of a high voltage applied to the electrostatic coater is reduced to cause a decrease in coating quality and a decrease in coating efficiency. Thus, there occurs a problem that a power amount supplied to the electrostatic coater needs to be increased in order to maintain the same absolute value of the high voltage applied to the electrostatic coater as that of a conventional case.

An object of the present invention is to provide an electrostatic coater and an electrostatic coating method capable of neutralizing a charge remaining in the electrostatic coater at an early stage when power supply to the electrostatic coater is stopped.

Another object of the present invention is to provide an electrostatic coater capable of preventing a spark discharge from occurring between the electrostatic coater and a workpiece when a voltage applied to the electrostatic coater is increased and/or when a distance between the electrostatic coater and the workpiece is decreased in order to improve coating efficiency of electrostatic coating.

Yet another object of the present invention is to provide an electrostatic coater having safety measures instead of bleeder resistance when power supply to the electrostatic coater is forcibly stopped based on an electrostatic system that detects a value of a current flowing between the electrostatic coater and a workpiece, and forcibly stops the power supply to the electrostatic coater when the value indicates an abnormal value.

SUMMARY OF THE INVENTION

According to a first aspect of the present invention, the above technical objects are achieved by providing an electrostatic coater that charges an atomized paint to cause the paint to attach to a workpiece, the electrostatic coater comprising:

an operation high-voltage generator for generating a high voltage for charging the paint during operation in which the workpiece is coated by using the electrostatic coater; and a second high-voltage generator for generating a high voltage of reverse polarity to polarity of the high voltage generated by the operation high-voltage generator, wherein the second high-voltage generator generates the high voltage for neutralizing a charged state of the electrostatic coater upon receiving power supply immediately after power supply to the operation high-voltage generator is stopped.

According to a second aspect of the present invention, the above technical objects are achieved by providing an electrostatic coater that charges an atomized paint to cause the paint to attach to a workpiece, the electrostatic coater including:

an operation high-voltage generator for generating a high voltage for charging the paint during operation in which the workpiece is coated by using the electrostatic coater; and an ion generator for generating ions of reverse polarity to polarity of the high voltage generated by the operation high-voltage generator, wherein the ion generator is arranged in an air passage that supplies air to the electrostatic coater, and air ionized by the ion generator 1*s* supplied to the electrostatic coater to neutralize a charged state of the electrostatic coater immediately after power supply to the operation high-voltage generator is stopped.

According to a third aspect of the present invention, the above technical objects are achieved by providing an electrostatic coating method for charging an atomized paint to cause the paint to attach to a workpiece by using an electrostatic coater, the electrostatic coating method including:

a coating step of causing the charged paint to attach to the workpiece; and a neutralizing step of neutralizing a charged state of a charged portion of the electrostatic coater by applying a high voltage of reverse polarity to polarity of a charge electrified on the electrostatic coater to the electrostatic coater immediately after the coating step is finished.

Here, the "neutralization" in the present invention is not limited to a meaning in which the charge existing in the electrostatic coater immediately after the running stop becomes "zero". The "neutralization" in the present invention includes a meaning in which the charge is reduced to a charge amount where a spark discharge accident by the electrostatic coater immediately after the running stop can be avoided.

Other objects of the present invention and advantages of the present invention will be apparent from the following detailed description of preferred embodiments of the present invention.

DETAILED DESCRIPTION OF THE PRESENT INVENTION

Figure 1:
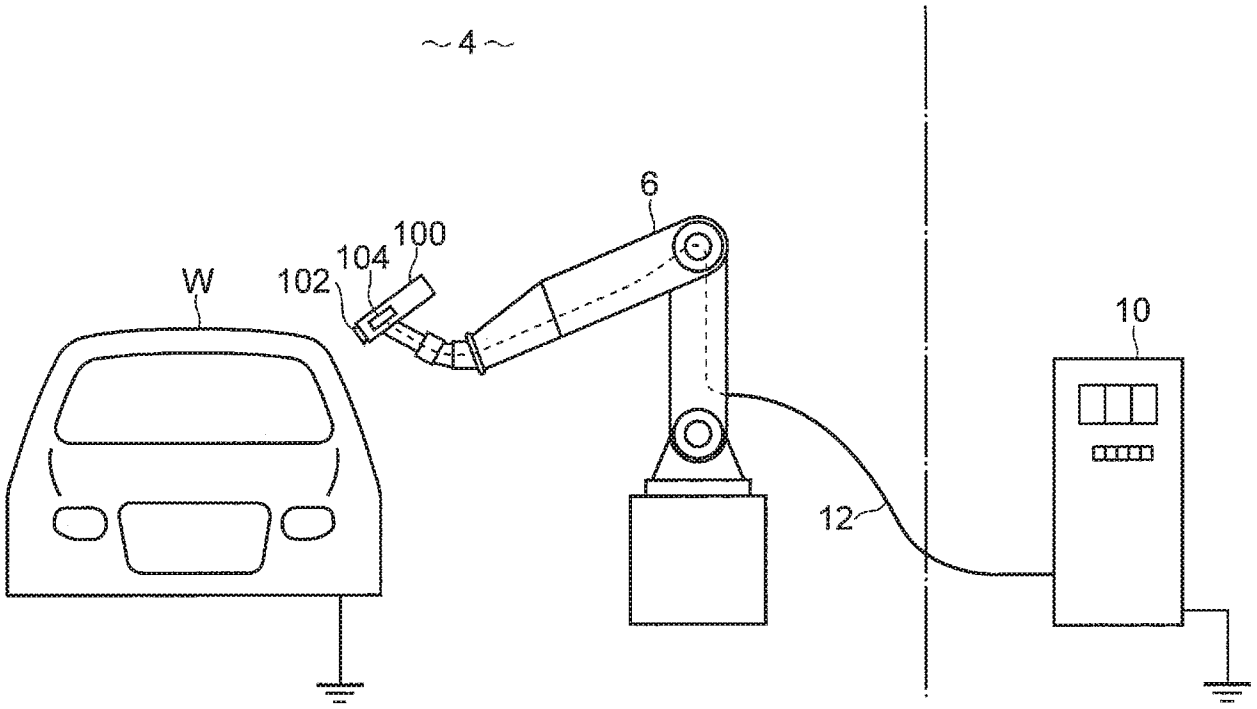
FIG. 1 shows a diagram for explaining an outline of a coating robot to which an electrostatic coater of an embodiment is mounted, and an automobile coating booth in which the coating robot is installed.

In the following, preferred embodiments of the present invention will be described based on the accompanying drawings. FIG. 1 shows a diagram for explaining a general outline of a coating system 2 as one example. The coating system 2 in the drawing is applied to coating of automobiles.

Figure 2:
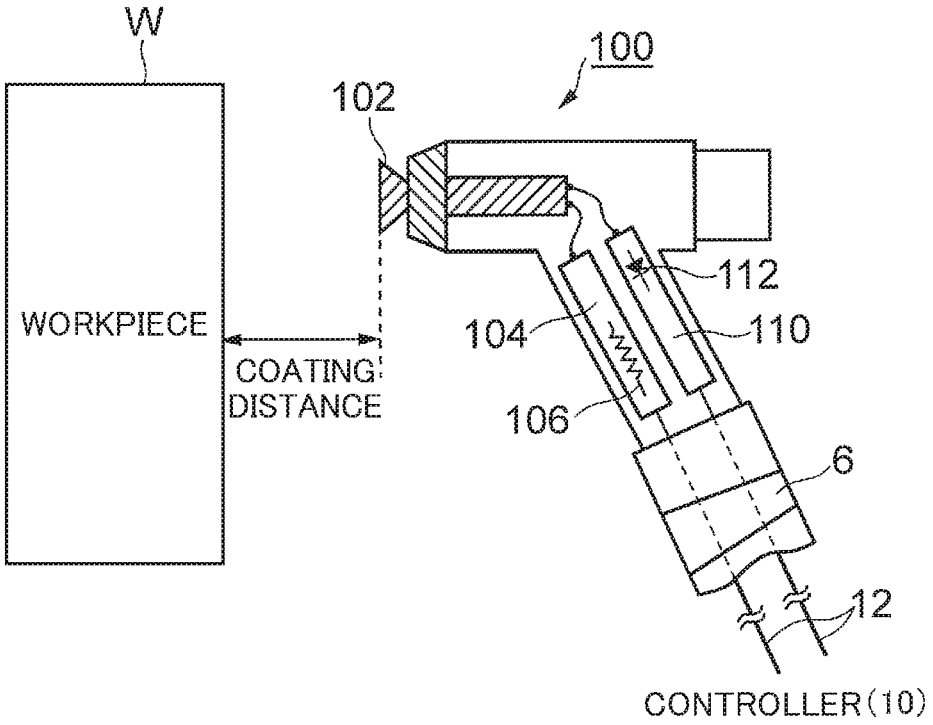
FIG. 2 shows a diagram for explaining an outline of an electrostatic coater of a first embodiment.
Figure 3:
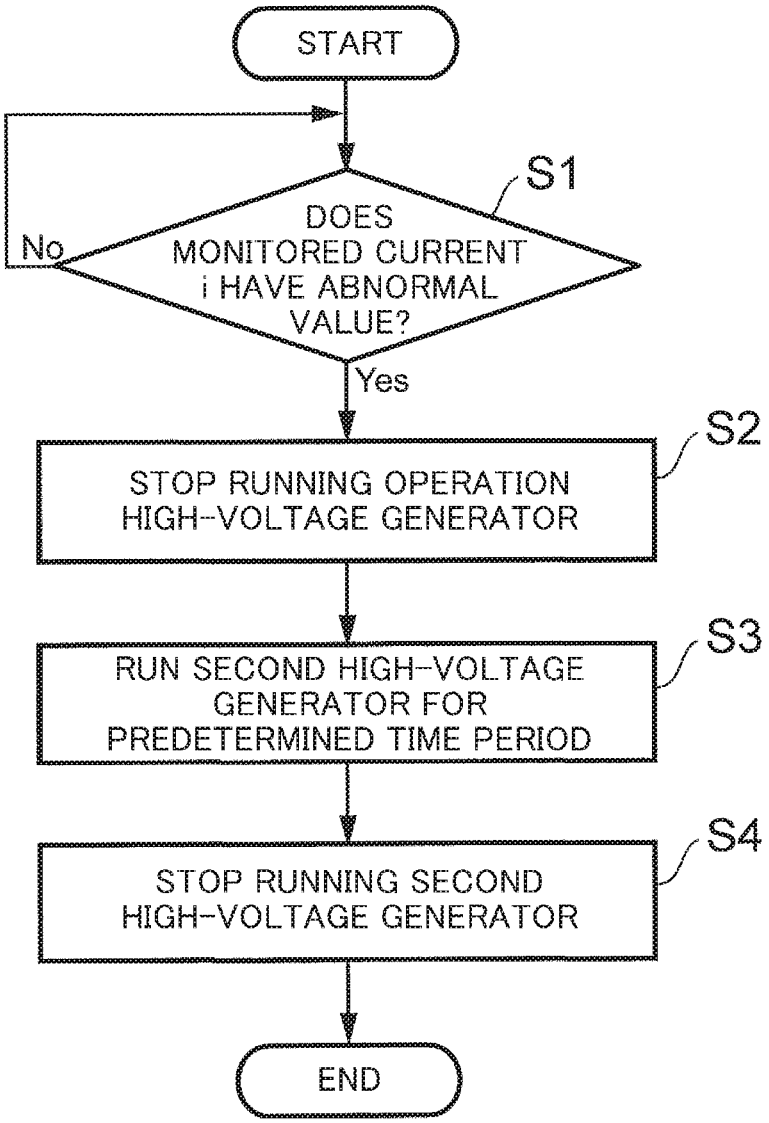
FIG. 3 shows a flowchart for explaining one example of control of the electrostatic coater of the first embodiment.

First Embodiment (FIGS. 1 to 3)

By reference to FIG. 1, reference numeral 4 denotes a coating booth. An explosion-proof space is formed by the coating booth 4. A plurality of coating robots 6 are installed in the coating booth 4. An electrostatic coater 100 of a first embodiment is mounted to a distal end of an arm of each of the coating robots 6. Electrostatic coating is given to an automobile W by the coating robots 6. The automobile W is an object to be coated (a workpiece) fed into the coating booth 4.

A controller 10 is installed outside the coating booth 4. The controller 10 and the electrostatic coater 100 are connected via a low-voltage (LV) cable 12. A high voltage of the electrostatic coater 100 is controlled by the controller 10. The controller 10 includes a safety circuit, which stops running of the electrostatic coater 100 when detecting that the electrostatic coater 100 is in a dangerous state. Since the above configuration including the safety circuit is conventionally well known, a detailed description thereof is omitted.

FIG. 2 shows a diagram for explaining an outline of an internal structure of the electrostatic coater 100 of the first embodiment. By reference to FIG. 2, the electrostatic coater 100 is a rotary-atomizing coater. The rotary-atomizing electrostatic coater 100 includes a rotary atomizing head 102 at its distal end. The rotary atomizing head 102 is called a "bell cup" in the industry. The rotary atomizing head 102 is driven by an air motor (not shown). A high-voltage generator 104 that supplies a high voltage to the rotary atomizing head 102 is incorporated in the electrostatic coater 100. In the following description, the high-voltage generator 104 is referred to as an "operation high-voltage generator". The operation high-voltage generator 104 is called a "cascade" in the industry. The cascade includes a bleeder resistance 106.

The operation high-voltage generator 104 is generally composed of a Cockcroft-Walton circuit. As is well known, the Cockcroft-Walton circuit is composed of diodes and capacitors. Since the Cockcroft-Walton circuit and the bleeder resistance 106 are described in detail in Patent Literature 1, the disclosure in Patent Literature 1 is incorporated herein, so that a detailed description thereof is omitted.

Note that the operation high-voltage generator 104 may be incorporated in the electrostatic coater 100, or may be incorporated outside the electrostatic coater 100, e.g., in the coating robot 6.

The operation high-voltage generator 104 generates a high voltage of negative polarity, and supplies the high voltage to the rotary atomizing head 102. Note that the automobile W fed into the coating booth 4 is maintained in a grounded state. Fine paint particles discharged from the rotary atomizing head 102 of the electrostatic coater 100 are in a negatively-charged state, and the paint particles charged with a negative potential are electrostatically attracted to the grounded automobile W, and electrostatically attach to the automobile W. This is a principle of electrostatic coating.

The electrostatic coater 100 of the first embodiment further includes a second high-voltage generator 110. The second high-voltage generator 110 generates a high voltage of reverse polarity to that of the above first operation high-voltage generator 104. A conductor portion (a charged portion) of the electrostatic coater 100 is indicated by oblique lines in FIG. 2. The second high-voltage generator 110 1*s* connected to the conductor portion (the charged portion) of the electrostatic coater 100. That is, the second high-voltage generator 110 can generate a high voltage of positive polarity to supply the high voltage to the rotary atomizing head 102.

In addition to the second high-voltage generator 110, the electrostatic coater 100 may include a device (typically, a diode) 112 having a rectifying function to cause a current to flow only in one direction. As described above, the charged portion of the electrostatic coater 100 is indicated by oblique lines in FIG. 2. It is preferable to arrange the rectifying device 112 adjacent to the charged portion. Most preferably, the second high-voltage generator 110 is composed of a Cockcroft-Walton circuit. Since the Cockcroft-Walton circuit includes a diode as described above, the diode in the Cockcroft-Walton circuit can be caused to function as the above rectifying device 112.

By providing the above rectifying device 112 in the electrostatic coater 100, it is possible to prevent the high voltage generated by the operation high-voltage generator 104 from leaking outside through the second high-voltage generator 110 during operation of the electrostatic coater 100.

One example of control of the second high-voltage generator 110 will be described based on a flowchart in FIG. 3. First, in step S1, a current is flowing between the electrostatic coater 100 and the workpiece W is monitored, and it is determined whether or not the current i has a value within a normal range. When the monitored current i indicates an abnormal value, the control proceeds to step S2. In step S2, power supply to the operation high-voltage generator 104 included in the electrostatic coater 100 is forcibly stopped by assuming that the electrostatic coater 100 abnormally approaches the workpiece W.

By stopping the power supply to the operation high-voltage generator 104, the operation high-voltage generator 104 (the cascade) loses its function to generate the high voltage of negative polarity, and resultantly cannot supply the high voltage of negative polarity to the rotary atomizing head 102. The rotary atomizing head 102 and the air motor or the like, to which the high voltage of negative polarity has been supplied until just before the supply stop, remain in a state of being charged with negative polarity, while the electrification charge is discharged outside through the bleeder resistance 106 included in the cascade.

In step S3 subsequent to step S2 described above, power supply to the second high-voltage generator 110 is started. The second high-voltage generator 110 generates the high voltage of positive polarity to supply the high voltage to the rotary atomizing head 102. Subsequently, in step S4, the power supply to the second high-voltage generator 110 is stopped after passage of a predetermined time period from the start of the power supply to the second high-voltage generator 110.

The forced running stop of the operation high-voltage generator 104. Is performed not only when the monitored current i is abnormal as described above, but also when the safety circuit of the controller 10 detects abnormality. Items in which the safety circuit detects abnormality are exemplified as follows.

(1) Absolute sensitivity abnormality (COL): An IM amount 1 s sampled at predetermined intervals, and the sampled IM amount is compared with a COL sensitivity threshold. When a plurality of the IM amounts in succession are larger than the COL sensitivity threshold, it is determined as COL abnormality.

(2) SLP (DiDt sensitivity abnormality): The IM amount sampled at predetermined intervals is compared with an SLP sensitivity threshold. When a plurality of the IM amounts in succession are larger than the SLP sensitivity threshold, it is determined as SLP abnormality.

(3) TCL (transformer primary current excessive abnormality): A CT transformer current is sampled at predetermined intervals, and the sampled current value is compared with a TCL sensitivity threshold. When a plurality of the current values in succession are larger than the TCL sensitivity threshold, it is determined as TCL abnormality.

(4) VO (Abnormal high voltage): A KV amount is sampled at predetermined intervals, and the sampled KV amount is compared with a VO sensitivity threshold. When a plurality of the KV amounts in succession are larger than the VO sensitivity threshold, it is determined as VOL abnormality.

(5) VU (Abnormal low voltage): The sampled KV amount is compared with a VU sensitivity threshold. When a plurality of the KV amounts in succession are smaller than the VU sensitivity threshold, it is determined as VOL abnormality.

(6) WT1 (AB-phase current difference): When a state in which a current difference between an A phase and a B phase is 0.5 A or more continues for a predetermined time period, it is determined as abnormality.

(7) WT2 (CT disconnection detection): If a transformer current continues to be O.1A or less for a predetermined time period when a high voltage value is 30 kV or more, it is determined as WT2 abnormality.

(8) WT3 (Detection of IM line short): If an average high-voltage current value (HEIIM) continues to be 5 μA or less for a predetermined time period when a high voltage monitor value (KVM) is 30 kV or more, it is determined as WT3 abnormality.

When the safety circuit detects the above abnormality during the operation of the electrostatic coater 100, and forcibly stops the running of the above operation high-voltage generator 104, the control may proceed to step S3 described above to perform the power supply to the second high-voltage generator 110.

In the electrostatic coater 100 of the first embodiment, a value of the high voltage of negative polarity generated by the operation high-voltage generator 104 (the cascade) is, for example, −120 kV to −30 kV, and typically, −90 kV to −60 kV. In contrast, a value of the high voltage of positive polarity generated by the second high-voltage generator 110 is +20 kV to +30 kV. The value of +20 kV to +30 kV is merely an example, and an optimum value may be set by an experiment.

Even when the running of the operation high-voltage generator 104 is forcibly stopped in order to avoid danger, the front end portion of the electrostatic coater 100 including the rotary atomizing head 102, the air motor and the like is in the state of being charged with negative polarity. Immediately after the forced stop of the main high-voltage generator 104, the high voltage of reverse polarity is supplied to the rotary atomizing head 102 and the air motor from the second high-voltage generator 110 for a predetermined time period, so that the charged state with negative polarity of the charged portion (the oblique-line portion in FIG. 2) including the rotary atomizing head 102 of the electrostatic coater 100 can be immediately neutralized by the high voltage of reverse polarity.

The voltage value of the high voltage of reverse polarity may be changed according to magnitude of the value of the high voltage supplied to the rotary atomizing head 102 during the operation of the electrostatic coater 100. To be more specific, when the electrostatic coater 100 is operated by supplying a negative-polarity voltage of 90 kV to the rotary atomizing head 102, a voltage having a voltage value of 30 kV, as the voltage value of the high voltage of positive polarity as reverse polarity thereto, is supplied to the rotary atomizing head 102. On the other hand, when the electrostatic coater 100 is operated by supplying a negative-polarity voltage of 60 kV to the rotary atomizing head 102, a voltage having a voltage value of 20 kV, as the voltage value of the high voltage of positive polarity as reverse polarity thereto, is supplied to the rotary atomizing head 102.

To confirm the effect of the electrostatic coater 100 of the first embodiment, a case in which the second high-voltage generator 110 was not run (Comparative Example), and a case in which the second high-voltage generator 110 was run (the effect of the embodiment) were compared. In the case in which the second high-voltage generator 110 was not run as the Comparative Example, it required two seconds to discharge the electrification charge through the bleeder resistance 106. In contrast, in the case in which the second high-voltage generator 110 was run, the electrification charge was neutralized only by 0.5 seconds. Note that an operation voltage of the electrostatic coater 100 was −90 kV, and a time period required for neutralization (the above 0.5 seconds) was measured by determining that the electrification charge was neutralized when the value of the high voltage was reduced to −1 kV. The voltage value, that is, −1 kV is a value where no spark discharge possibly occurs. Of course, the second high-voltage generator 110 may be run until complete neutralization, that is, until the voltage value is reduced to ±0.

Modification (FIG. 4) of the First Embodiment

Figure 4:
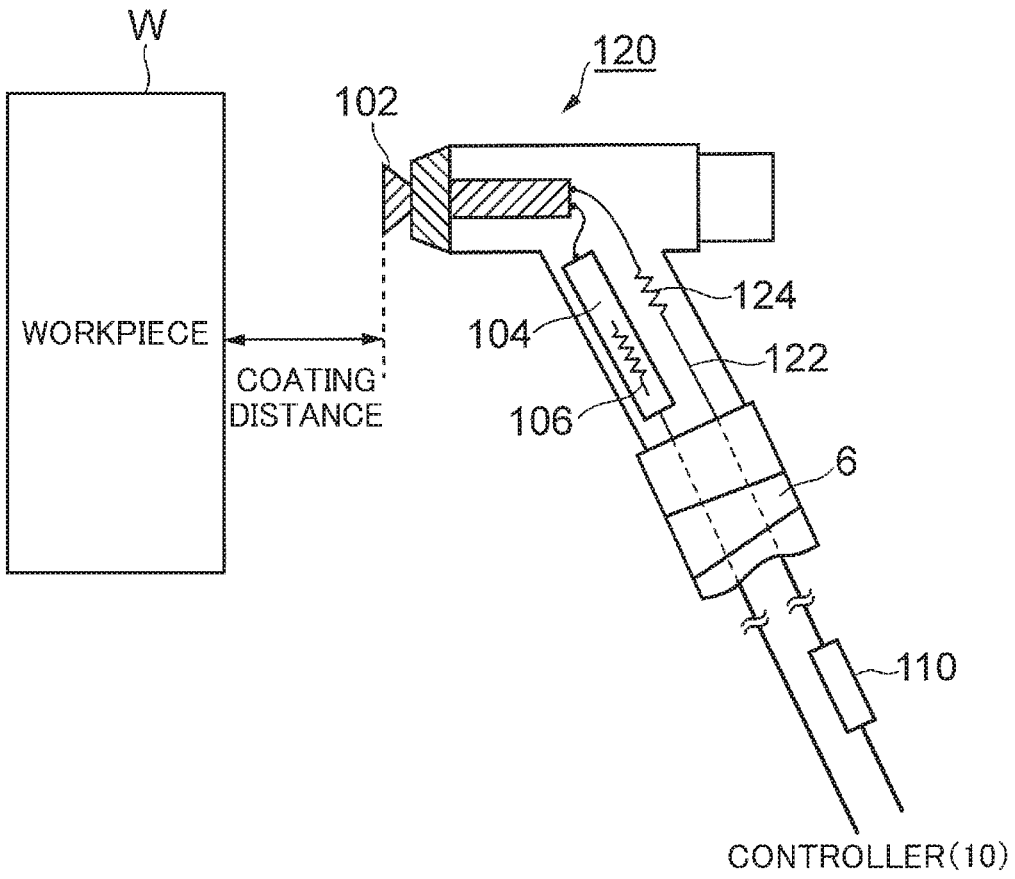
FIG. 4 shows a diagram for explaining an outline of an electrostatic coater of a modification of the first embodiment.

FIG. 4 shows a modification 120 of the electrostatic coater 100 of the first embodiment. In an electrostatic coater 120 shown in FIG. 4, the second high-voltage generator 110 is arranged outside the electrostatic coater 120 (for example, in the coating robot 6). The high voltage of positive polarity generated by the second high-voltage generator 110 is supplied to the conductor portion (the charged portion) of the electrostatic coater 120 through a conducting wire 122.

The electrostatic coater 120 internally includes resistance 124, and t h e resistance 124 is connected to the conducting wire 122. By interposing the resistance 124 in the conducting wire 122, apparent capacitance of the conducting wire 122 can be reduced. In other words, the conducting wire 122 for supplying the high voltage to the electrostatic coater 120 is a charged body of the electrostatic coater 120. By interposing the resistance 124 in the conducting wire 122, the capacitance of the conducting wire 122 can be practically lowered. As a modification of the electrostatic coater 120 shown in FIG. 4, a whole or a portion of the conducting wire 122 may be composed of a wire of a semiconductor instead of the above resistance 124.

Regarding the configuration in which the resistance 124 is interposed in the conducting wire 122 or the conducting wire 122 is composed of the wire of the semiconductor, it goes without saying that the configuration may be incorporated in the electrostatic coater 100 of the first embodiment described above.

Figure 5:
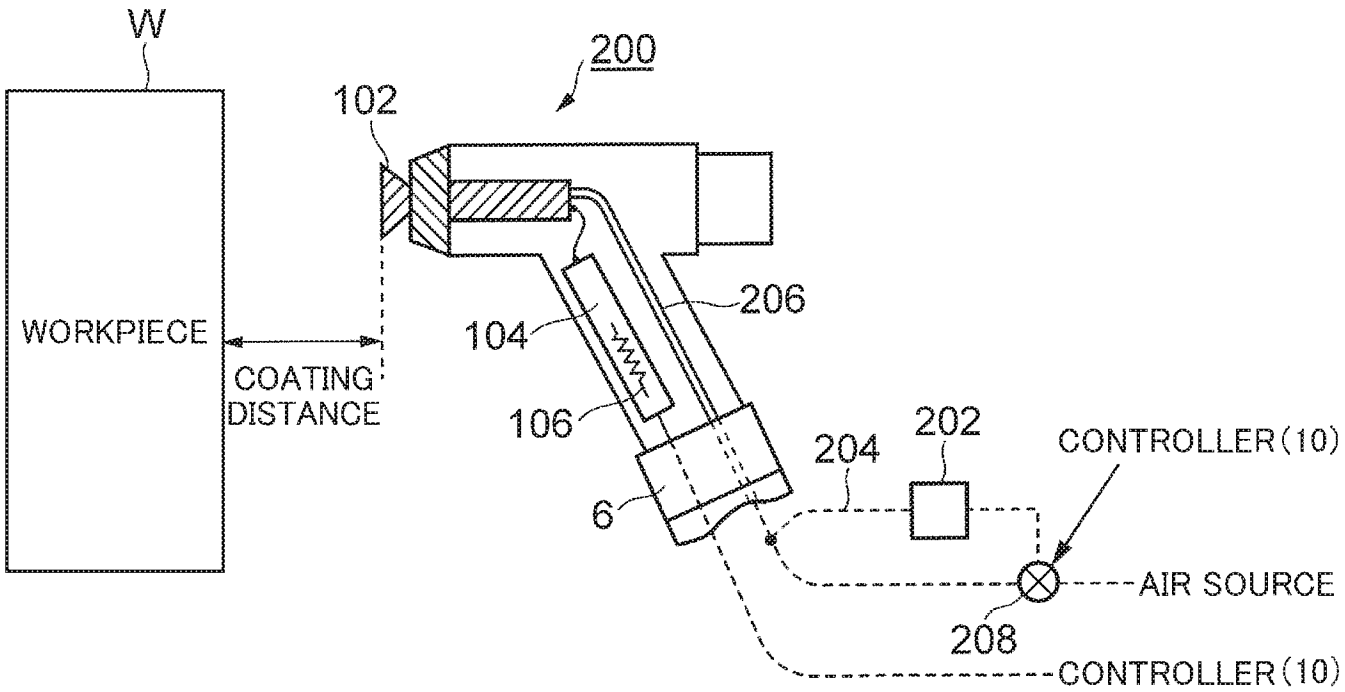
FIG. 5 shows a diagram for explaining an outline of an electrostatic coater of a second embodiment.

Second embodiment (FIGS. 5 and 6) FIG. 5 shows a diagram for explaining an outline of an electrostatic coater 200 of a second embodiment. Although the electrostatic coater 100 of the first embodiment employs the configuration in which the charge retained in the distal end portion of the electrostatic coater 100 is neutralized by supplying the voltage of reverse polarity (positive polarity) to the rotary atomizing head 102 as described above, the electrostatic coater 200 of the second embodiment (FIG. 5) employs a configuration in which the charge remaining in the distal end portion of the electrostatic coater 200 is neutralized by supplying air charged with reverse polarity (positive polarity) to the electrostatic coater 200.

In a description of the electrostatic coater 200 of the second embodiment, the same elements as those of the electrostatic coater 100 of the above first embodiment are assigned the same reference numerals, and a description thereof is omitted.

The electrostatic coater 200 of the second embodiment externally includes an ion generator 202 that generates plus ions, and the ion generator 202 is installed in an ionized air pipe 204. The ionized air pipe 204 leads to an air source (not shown). The electrostatic coater 200 includes a passage switching valve 208 that is interposed in an air-system pipe 206 such as a shaping air passage and the air motor, and the above ionized air pipe 204 is connected to the passage switching valve 208.

Figure 6:
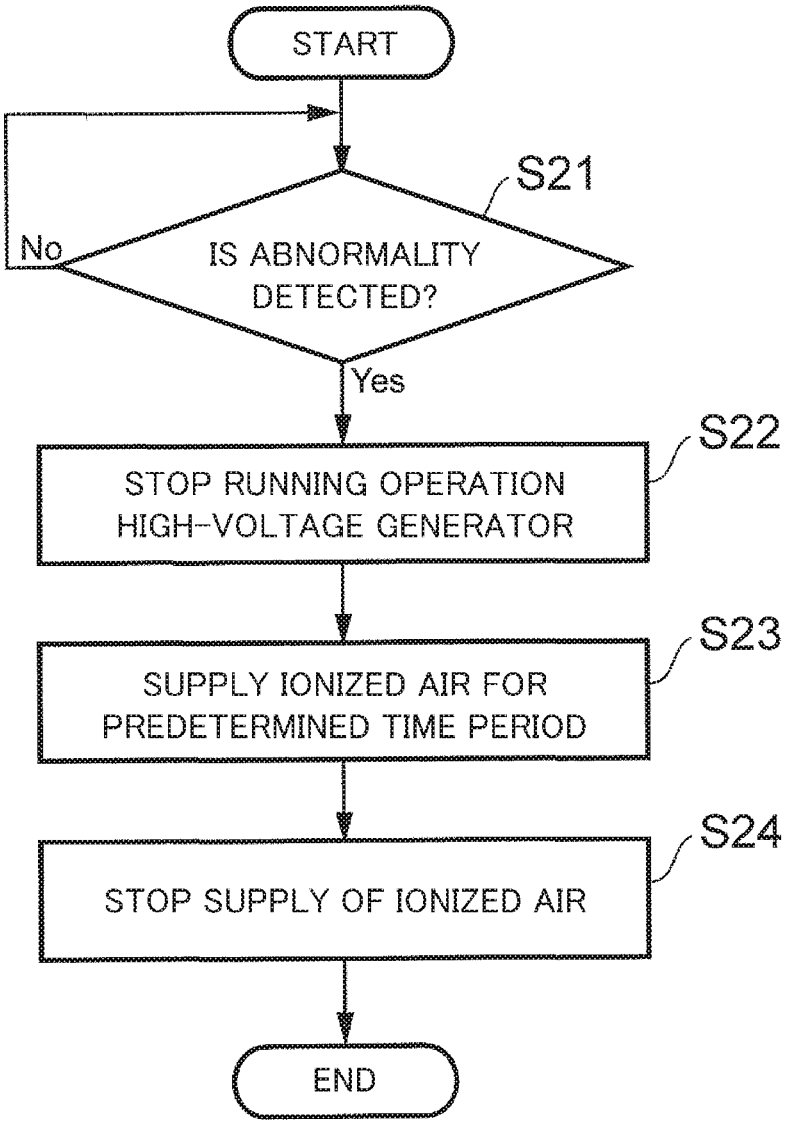
FIG. 6 shows a flowchart for explaining one example of control of the electrostatic coater of the second embodiment.

One example of control of the electrostatic coater 200 of the second embodiment will be described based on a flowchart in FIG. 6. When the safety circuit of the controller 10 detects abnormality in step S21, the control proceeds to step S22. In the step S22, a safety signal is output from the controller 10, and power supply to the operation high-voltage generator 104 (the cascade) included in the electrostatic coater 200 is forcibly stopped. In next step S23, power is supplied to the ion generator 202, and the passage switching valve 208 is switched based on an instruction from the controller 10. Accordingly, air ionized in positive polarity generated by the ion generator 202 1*s* introduced into the electrostatic coater 200, and the air ionized in positive polarity 1*s* supplied to the shaping air passage and the air motor of the electrostatic coater 200. After the ionized air is continuously supplied for a predetermined time period, the air supply to the electrostatic coater 200 is stopped, so that the electrostatic coater 200 is brought into a suspended state (S24).

As a time period in which the air ionized in positive polarity is supplied to the electrostatic coater 200, a fixed time period may be set regardless of magnitude of an absolute value of the operation voltage of the electrostatic coater 200, or the time period in which the air ionized in positive polarity is supplied may be made different according to the magnitude of the absolute value of the operation voltage. For example, when the operation voltage of the electrostatic coater 200 is −90 kV, the time period in which the ionized air is supplied may be set to a relatively long time period. For example, when the operation voltage of the electrostatic coater 200 is −60 kV, the time period in which the ionized air is supplied may be set to a relatively short time period.

The time period in which the air ionized in positive polarity is supplied to the electrostatic coater 200 may be set to a time period in which the charged state with negative polarity of the front end portion of the electrostatic coater 200 can be neutralized by the reverse-polarity ionized air when the supply of the operation voltage (the high voltage of negative polarity) to the electrostatic coater 200 is forcibly stopped. While the time period may be determined by an experiment, the time period may be set to a time period required for completely neutralizing the charged state with negative polarity of the front end portion of the electrostatic coater 200, or a time period required until the charged state reaches a practically neutralized point by considering a point where the charged state is reduced to a level at which safety can be ensured (e.g., a point where a potential of the rotary atomizing head 102 is reduced to 1 kV) as the practically neutralized point.

The control of actively neutralizing the charged state of the charged portions of the electrostatic coaters 100 and 200 when the controller 10 detects abnormality and stops the power supply to the operation high-voltage generator 104 that generates the high voltage of negative polarity has been described above. The present invention is not limited thereto, and even when the running of the first and second electrostatic coaters 100 and 200 is stopped in normal control during the operation of the first and second electrostatic coaters 100 and 200, the control of actively neutralizing the charged state of the charged portions of the first and second electrostatic coaters 100 and 200 that have stopped running may be performed.

In accordance with the electrostatic coaters 100 and 200 of the first and second embodiments, a danger level of the charged state of the charged portions of the electrostatic coaters 100 and 200 can be immediately lowered, so that an occurrence risk of a spark discharge along with the approach of the electrostatic coaters 100 and 200 and the workpiece W can be significantly reduced. For example, even when the controller 10 detects abnormality and stops running of the coating robot 6, the robot 6 approaches the workpiece W by inertia, though only by about a few cm. Even in this situation, the electrostatic coaters 100 and 200 of the first and second embodiments can effectively suppress the occurrence of the spark discharge.

As described above, even when the electrostatic coaters 100 and 200 of the embodiments approach the workpiece W, the occurrence of the spark discharge can be avoided. In other words, a coating work can be executed in a state in which the electrostatic coaters 100 and 200 are located closer to the workpiece W than that in a conventional case, so that coating efficiency can be improved. While a distance (a coating distance) between the workpiece W and a coater is set to about 30 cm to ensure safety in conventional electrostatic coating, the electrostatic coaters 100 and 200 of the embodiments can perform coating by setting the coating distance to a distance smaller than 30 cm. When the coating distance is decreased, the coating efficiency can be improved.

The present invention can be widely applied to the electrostatic coating. To be more specific, although the rotary-atomizing coater has been described in the embodiments, the present invention can be also applied to an air-atomizing electrostatic coater (including a handgun), and a hydraulically-atomizing electrostatic coater (including a handgun). Also, although the embodiments have been described by using the coating robot as an example, the present invention can be effectively applied to a reciprocator as well as the coating robot.

W Automobile (Object to be coated: Workpiece)
2 Coating system
4 Coating booth
6 Coating robot
10 Controller
100 Electrostatic coater of the first embodiment
102 Rotary atomizing head (Bell cup)
104 Operation high-voltage generator (Cockcroft-Walton circuit)
106 Bleeder resistance
110 Second high-voltage generator
122 Conducting wire
124 Resistance
200 Electrostatic coater of the second embodiment
202 Ion generator that generates plus ions
204 External pipe (Air supply pipe)
206 Air-system pipe
208 Passage
switching
valve

The invention claimed is:

1. An electrostatic coating method for charging a fluid, the method comprising:
charging the fluid with a first high voltage with a first polarity;
monitoring a current flow;
detecting an abnormal current value;
stopping the charging of the fluid with the first high voltage in response to the detection of the abnormal current value;
charging the fluid with a second high voltage with a second polarity, wherein the second polarity is opposite the first polarity, and wherein charging the fluid with the second high voltage neutralizes the first high voltage; and
blocking a flow of current through a second high voltage generator with a rectifying device while charging the fluid with the first high voltage.

2. The method of claim 1, comprising generating the first high voltage with a first high voltage generator.

3. The method of claim 1, comprising generating the second high voltage with the second high voltage generator.

4. The method of claim 1, comprising varying a second voltage value of the second high voltage based on a first voltage value of the first high voltage.

5. The method of claim 1, wherein the second high voltage generator and the rectifying device are in series.

6. The method of claim 1, wherein charging the fluid with the second high voltage comprises charging the fluid with the second high voltage for a predetermined time period.

7. The method of claim 1, comprising reducing a charge produced by the second high voltage generator that generates the second high voltage in response to a decrease in a distance between an electrostatic coater and a workpiece.

8. An electrostatic coating method for charging a fluid, the method comprising:
charging the fluid with a first high voltage with a first polarity;
monitoring current flow;
detecting an abnormal current value;
stopping the charging of the fluid with the first high voltage in response to detection of the abnormal current value; and
generating ions with a second polarity in a fluid passage, wherein the second polarity is opposite the first polarity, and wherein the ions neutralize the first high voltage.

9. The method of claim 8, comprising generating the first high voltage with a first high voltage generator.

10. The method of claim 8, comprising generating the ions with an ion generator.

11. The method of claim 8, wherein the fluid passage comprises an air passage coupled to an electrostatic coater.

12. The method of claim 8, wherein generating the ions comprises generating the ions for a predetermined time period.

13. A system comprising:
a controller configured to control electrostatic coating by electrically charging a coating fluid, the controller controls charging of the coating fluid with a first high voltage with a first polarity, the controller monitors current flow and detects an abnormal current value and in response to the abnormal current value the controller stops the charging of the coating fluid with the first high voltage and charges the coating fluid with a second high voltage with a second polarity, the second polarity is opposite the first polarity, and wherein the second high voltage neutralizes the first high voltage; and a rectifying device configured to block a flow of current through a second high voltage generator while charging the coating fluid with the first high voltage.

14. The system of claim 13, comprising a first high voltage generator that generates the first high voltage with the first polarity.

15. The system of claim 13, wherein the second high voltage generator is configured to generate the second high voltage with the second polarity.

16. The system of claim 13, wherein the controller comprises a safety control configured to detect one or more abnormalities to trigger the stop in the charging of the coating fluid with the first high voltage and to charge the coating fluid with the second high voltage, and wherein the one or more abnormalities comprise at least one of: a sensitivity abnormality, a transformer abnormality, an abnormal high voltage, an abnormal low voltage, a phase current difference abnormality, or a line short abnormality.

17. The system of claim 13, wherein the second high voltage generator and the rectifying device are in series.

18. The system of claim 13, wherein the controller is configured to charge the coating fluid with the second high voltage for a predetermined time period.

19. The system of claim 13, wherein the controller is configured to reduce a charge produced by the second high voltage generator that generates the second high voltage in response to a decrease in a distance between an electrostatic coater and a workpiece.

20. The system of claim 13, comprising an electrostatic coater configured to spray the coating fluid.

* * * * *